US007900907B2

(12) United States Patent
Furihata et al.

(10) Patent No.: US 7,900,907 B2
(45) Date of Patent: Mar. 8, 2011

(54) MEDIA PROCESSING DEVICE

(75) Inventors: Hideki Furihata, Okaya (JP); Toshiyuki Sasaki, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/009,453

(22) Filed: Jan. 18, 2008

(65) Prior Publication Data

US 2008/0197559 A1 Aug. 21, 2008

(30) Foreign Application Priority Data

Feb. 19, 2007 (JP) ..... 2007-037455

(51) Int. Cl.
*B65H 5/22* (2006.01)

(52) U.S. Cl. ..... 271/4.1; 271/270; 271/10.11

(58) Field of Classification Search ..... 271/10.11, 271/10.12, 242, 4.1, 4.08, 10.09, 270
See application file for complete search history.

(56) References Cited

U.S. PATENT DOCUMENTS

| | | | | |
|---|---|---|---|---|
| 2,992,821 | A * | 7/1961 | Whitney | 271/230 |
| 4,721,093 | A * | 1/1988 | Bullock et al. | 362/308 |
| 5,423,527 | A * | 6/1995 | Tranquilla | 271/10.02 |
| 6,005,687 | A * | 12/1999 | Kawashima et al. | 358/498 |
| 6,128,107 | A * | 10/2000 | Kawashima | 358/498 |
| 6,397,035 | B2 * | 5/2002 | Kataoka et al. | 399/388 |
| 6,674,979 | B2 * | 1/2004 | Nagano | 399/68 |
| 2002/0063384 | A1 * | 5/2002 | Quesnel | 271/270 |
| 2003/0214096 | A1 * | 11/2003 | Onodera | 271/264 |
| 2004/0257626 | A1 | 12/2004 | Panini et al. | |
| 2006/0012104 | A1 * | 1/2006 | Kim | 271/10.01 |

FOREIGN PATENT DOCUMENTS

| | | | |
|---|---|---|---|
| JP | 61-166447 | * | 7/1986 |
| JP | 10-111964 | | 4/1998 |
| JP | 2001-048362 | | 2/2001 |
| JP | 2004-206362 | | 7/2004 |

* cited by examiner

*Primary Examiner* — Stefanos Karmis
*Assistant Examiner* — Thomas A Morrison
(74) *Attorney, Agent, or Firm* — Nutter McClennen & Fish LLP; John J. Penny, Jr.; Rory P. Pheiffer

(57) ABSTRACT

A media processing device can convey checks at a constant speed passed an information reading position without slipping and without increasing the relay capacity of the transportation roller. The check processing device 1 has two transportation rollers 31 and 32 between the scanning position 52A of the contact image scanner 52 and the separation roller 17 and retard roller 18 that produce a transportation load or transportation load variation. The upstream-side transportation roller 31 turns faster than the downstream transportation roller 32 so that the checks 4 are fed with slack between these transportation rollers 31 and 32. Because of this slack in the part 402 of the check 4 between the transportation rollers 31 and 32, the transportation load from the separation mechanism does not act on the downstream transportation roller 32. The transportation load acting on the transportation roller 32 that feeds the checks 4 to the scanning position 52A can thus be reduced, variation in the transportation load can be suppressed, checks can be conveyed at a constant speed to the scanning position 52A, and a drop in the reading accuracy of the contact image scanner 52 can be prevented.

7 Claims, 7 Drawing Sheets

MEDIA PROCESSING DEVICE

BACKGROUND OF THE INVENTION

1. Field of Invention

The present invention relates to a media processing device that reads contained information such as magnetic ink characters and image information from sheet media such as checks while conveying the media one at a time through a transportation path, and relates more particularly to a media processing device that can suppress fluctuations in the sheet media transportation speed so that the contained information can be accurately scanned.

2. Description of Related Art

Banks and other financial institutions use check readers to image and read magnetic ink characters from checks, promissory notes, and other check-like negotiable instruments, and to sort the checks based on the acquired information. As electronic check processing has become more common in recent years the scanned image data and magnetic ink character data is also processed and managed using computers. See, for example, the check readers taught in Japanese Unexamined Patent Appl. Pub. JP-A-2004-206362, U.S. Patent Application 2004/025626, and Japanese Unexamined Patent Appl. Pub. JP-A-2001-48362.

Separation mechanisms for separating and feeding multifed checks and other sheet media one by one for processing include pad separation devices and retard roller devices. Pad separation devices push the end part of the sheet media against a separation pad that is made from a material with a high coefficient of friction while driving a feed roller to separate and feed one sheet medium. Retard roller devices separate the sheet media by passing the media between a media feed roller and a retard roller, which is pressed against the media feed roller and applies a rotational load. Both methods create resistance to the transportation direction of the sheet media being fed in order to separate multifed sheet media one by one in the transportation direction.

Japanese Unexamined Patent Appl. Pub. JP-A-2001-48362 teaches a sheet supply mechanism for separating and supplying high rigidity sheet media one by one. This sheet supply mechanism rotatably supports a separation pad so that the contact surface of the separation pad tightly contacts the end of the sheets supplied from inside a cassette case, and prevents sheets from being supplied in a stack to the retard roller type separation roller.

The transportation mechanism for conveying sheet media fed that are fed one at a time through a separation mechanism as described in Japanese Unexamined Patent Appl. Pub. JP-A-2004-206362 and U.S. Patent Application 2004/025626 transfers torque from a transportation motor through an intervening endless belt to a plurality of transportation rollers disposed along the transportation path, and sequentially conveys the sheet medium from an upstream-side transportation roller to the next downstream-side transportation roller along the transportation path.

If the check speed is fast, if the coefficient of friction between the check and the transportation roller is low because the check surface is particularly smooth, for example, or if the check transportation load is high, a certain small amount of slippage between the transportation roller and check occurs even if the relay capacity (μF) of the transportation roller is increased. If the check being conveyed slips while information is being read by the magnetic head or scanner, the reading accuracy of the information drops because of fluctuations in the transportation speed.

Furthermore, because the separation mechanism separates the media by applying a resistance to the transportation direction, the transportation load when conveying a check varies greatly depending on whether a part of the check is still inside the separation mechanism or whether the check has completely passed the separation mechanism and no part is still inside the separation mechanism. The check causes this variation in the transportation resistance of the separation mechanism to directly affect the transportation roller that receives and conveys the check from the separation mechanism to the scanning position of the scanner, for example. This produces slipping between the transportation roller and the check, which causes the speed of the check to vary as it is conveyed while being read by the scanner, for example, and can result in a drop in scanning precision and reading accuracy.

The nipping pressure (F) applied by the transportation roller to the check must be increased to increase the relay capacity of the transportation roller in order to reduce slipping of the checks conveyed by the transportation roller. However, this requires a design change, such as increasing the strength or rigidity of the transportation roller support shaft, which increases device size. Furthermore, because the required relay capacity of the transportation roller is affected by the coefficient of friction between the transportation roller and the surface of the check, differences in the condition of the check surface cause transportation roller slippage to vary. This causes the transportation speed to vary from check to check and reduces the reliability of information read from the checks.

SUMMARY OF THE INVENTION

A media processing device according to the present invention can convey sheet media at a constant speed of transportation passed an information scanning position without increasing the nip pressure of the transportation roller.

A media processing device according to a first embodiment of the invention has a media transportation path for conveying sheet media; an information reader that is disposed to an information reading position on the media transportation path and reads contained information on the sheet media passing the information reading position; a separation mechanism that separates and feeds the sheet media; and a transportation mechanism that conveys the sheet media delivered from the separation mechanism toward the information reading position. The transportation mechanism includes a first transportation roller disposed on an upstream side in the transportation direction, and a second transportation roller disposed on a downstream side in the transportation direction; and the sheet media transportation speed of the first transportation roller is faster than the transportation speed of the second transportation roller.

With the media processing device according to the invention sheet media delivered from the separation mechanism are fed first to the first transportation roller that turns at a fast media transportation speed, and then from there to the second transportation roller. The feed speed of the first transportation roller is set to be faster than the speed of the second transportation roller even if there is some slipping between the first transportation roller and the sheet medium. The sheet medium advanced to the second transportation roller is thus conveyed at a slower speed than the transportation speed of the first transportation roller to the information reading position. As a result, slack is produced by this difference in roller speed in the part of the sheet media that is between the first transportation roller and the second transportation roller. This slack prevents the effect of resistance and transportation load imposed by the separation mechanism from being passed from the first transportation roller to the second transportation roller. More specifically, the transportation resistance produced by the separation mechanism acts on the first transportation roller but does not act on the second transportation roller. Variation in the load on the second transportation roller is therefore suppressed, and the sheet media can be conveyed passed the information reading position at a constant speed while the information reader scans the media without the second transportation roller slipping against the medium.

Preferably, the difference between the peripheral velocity of the first transportation roller and second transportation roller is approximately 2% to 3%. This difference prevents any effect on the second transportation roller even if the first transportation roller slips against the sheet medium.

If the transportation mechanism has an endless belt that engages the first transportation roller and second transportation roller and a common transportation motor, and rotationally drives the rollers by means of a common power transfer mechanism, the angular velocity of the first transportation roller and second transportation roller will be the same. In this case the outside diameter of the first transportation roller is preferably greater than the outside diameter of the second transportation roller.

If the outside diameter of the first transportation roller and the second transportation roller are the same, the same effect can be achieved by driving the first transportation roller at a faster angular velocity than the angular velocity of the second transportation roller.

Further preferably, the separation mechanism includes a separation roller and a retard roller that is pressed against the separation roller. This enables separating and feeding checks and other sheet media that are multifed one by one.

The separation mechanism may alternatively use a separation pad to separate and feed checks and other sheet media that are multifed one by one.

Further preferably, the information reader is a magnetic head and/or a scanner for reading magnetic ink characters or image data from the sheet media at the information reading position.

A media processing device according to the present invention disposes first and second transportation rollers between the information reader and the separation mechanism that produces a transportation load or variation in the transportation load. The transportation speed of the upstream-side first transportation roller is set to be greater than the transportation speed of the downstream-side second transportation roller even if the first transportation roller slips slightly against the sheet media, thereby producing slack in the sheet media between the first and second transportation rollers.

The invention therefore prevents the transportation load imposed by the separation mechanism from acting on the second transportation roller that feeds the sheet media to the information reading position. The transportation load on the second transportation roller can therefore be reduced and variation in the transportation load can be suppressed. The transportation speed is thus constant, and slipping between the second transportation roller and the sheet media can be minimized.

The invention can thus improve the relay capacity of the second transportation roller, convey the sheet media at a constant speed passed the information reading position, and prevent a drop in the reading accuracy of the information reader.

Other objects and attainments together with a fuller understanding of the invention will become apparent and appreciated by referring to the following description and claims taken in conjunction with the accompanying drawings.

DESCRIPTION OF PREFERRED EMBODIMENTS

A preferred embodiment of a check processing device according to the present invention is described below with reference to the accompanying figures.

Figure 1:
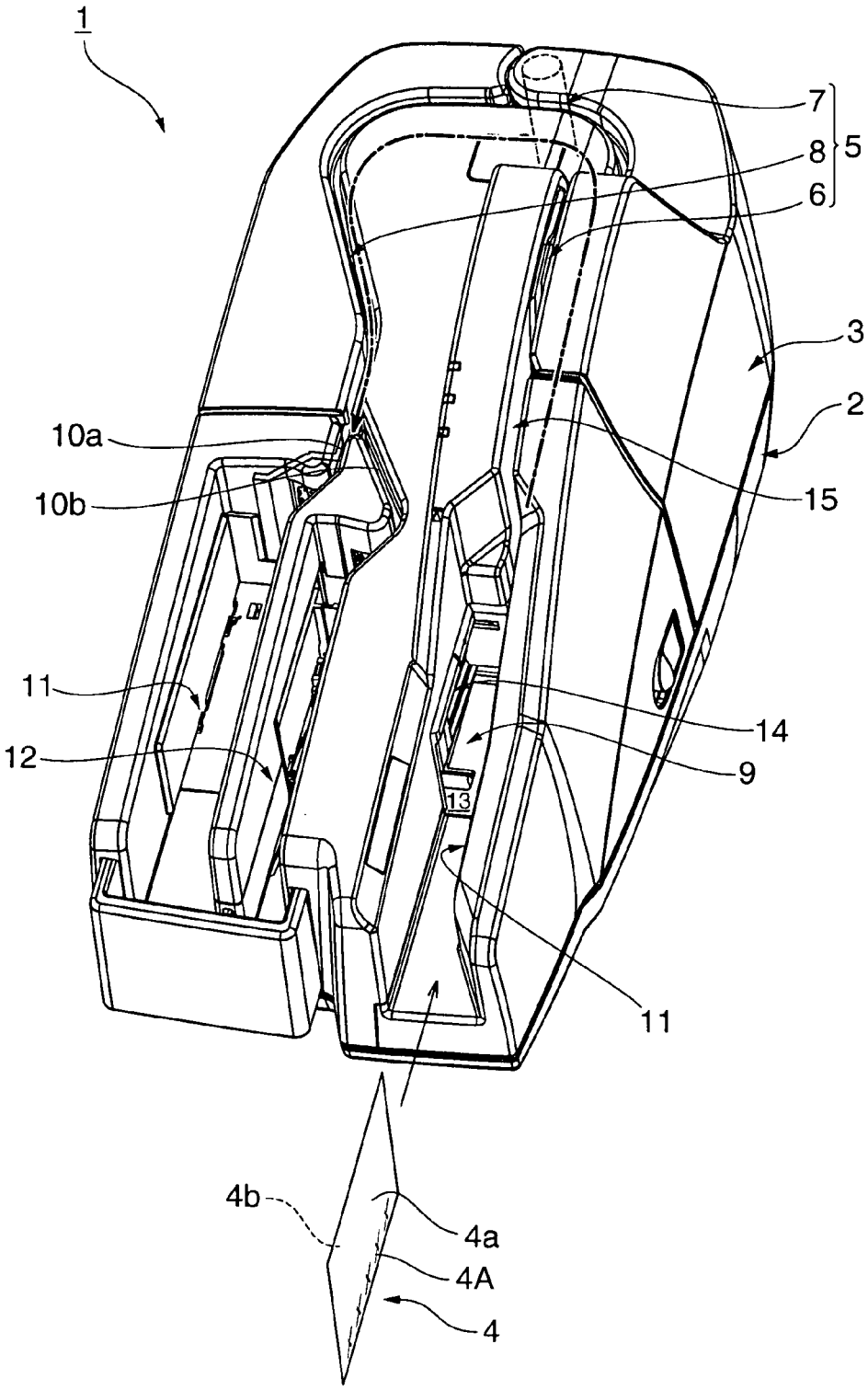
FIG. 1 is an external oblique view of a check processing device according to the invention.
Figure 2:
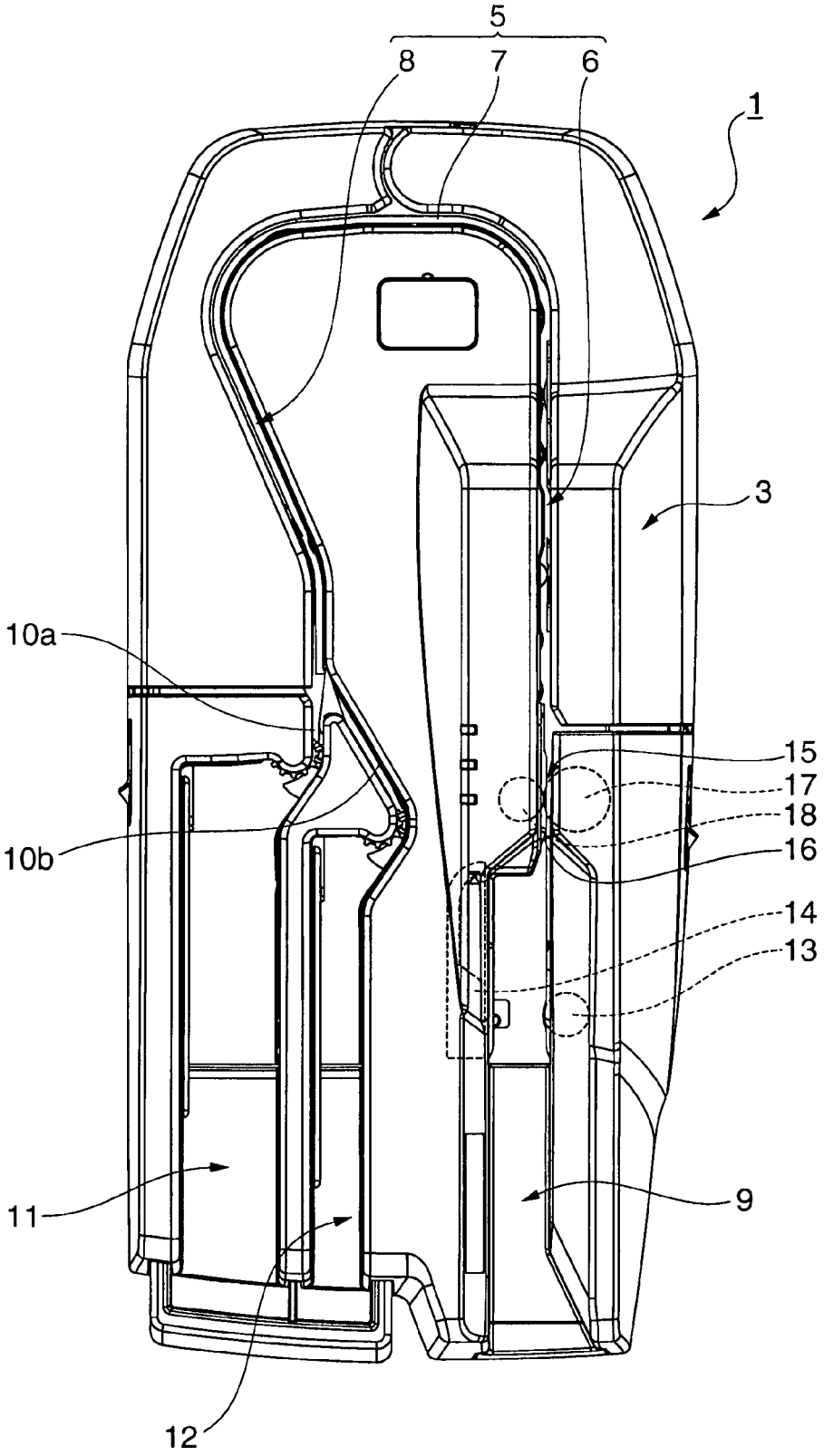
FIG. 2 is a plan view of the check processing device shown in FIG. 1.

FIG. 1 is an external oblique view of a check processing device 1 according to the invention, and FIG. 2 is a plan view of the same.

This check processing device 1 has a case 2 and a rear case 3 that covers the top of the case 2, and various parts and assemblies are disposed inside the case. A transportation path 5 for conveying checks 4 (sheet media) is formed in the rear case 3.

The check transportation path 5 is a narrow vertical slot that curves in a basically U-shaped configuration when seen from above, and includes a straight upstream-side transportation path portion 6, a curved transportation path portion 7 that continues from the upstream-side transportation path portion 6, and a slightly curving downstream-side transportation path portion 8 that continues from the curved transportation path portion 7.

The upstream end of the upstream-side transportation path portion 6 communicates with a check loading unit 9, which is a wide vertical slot. The downstream end of the downstream-side transportation path portion 8 is connected through left and right diversion paths 10*a*, 10*b* to first and second check discharge units 11 and 12, which are wide vertical slots.

The checks 4 that are read have an MICR line 4A printed along the bottom edge on the front 4*a* of the check 4. Also recorded on the front 4*a* against a patterned background are the check amount, payer and payee, various numbers, and the payer signature. An endorsement is recorded on the back 4*b* of the check 4.

Check Transportation Mechanism

Figure 3:
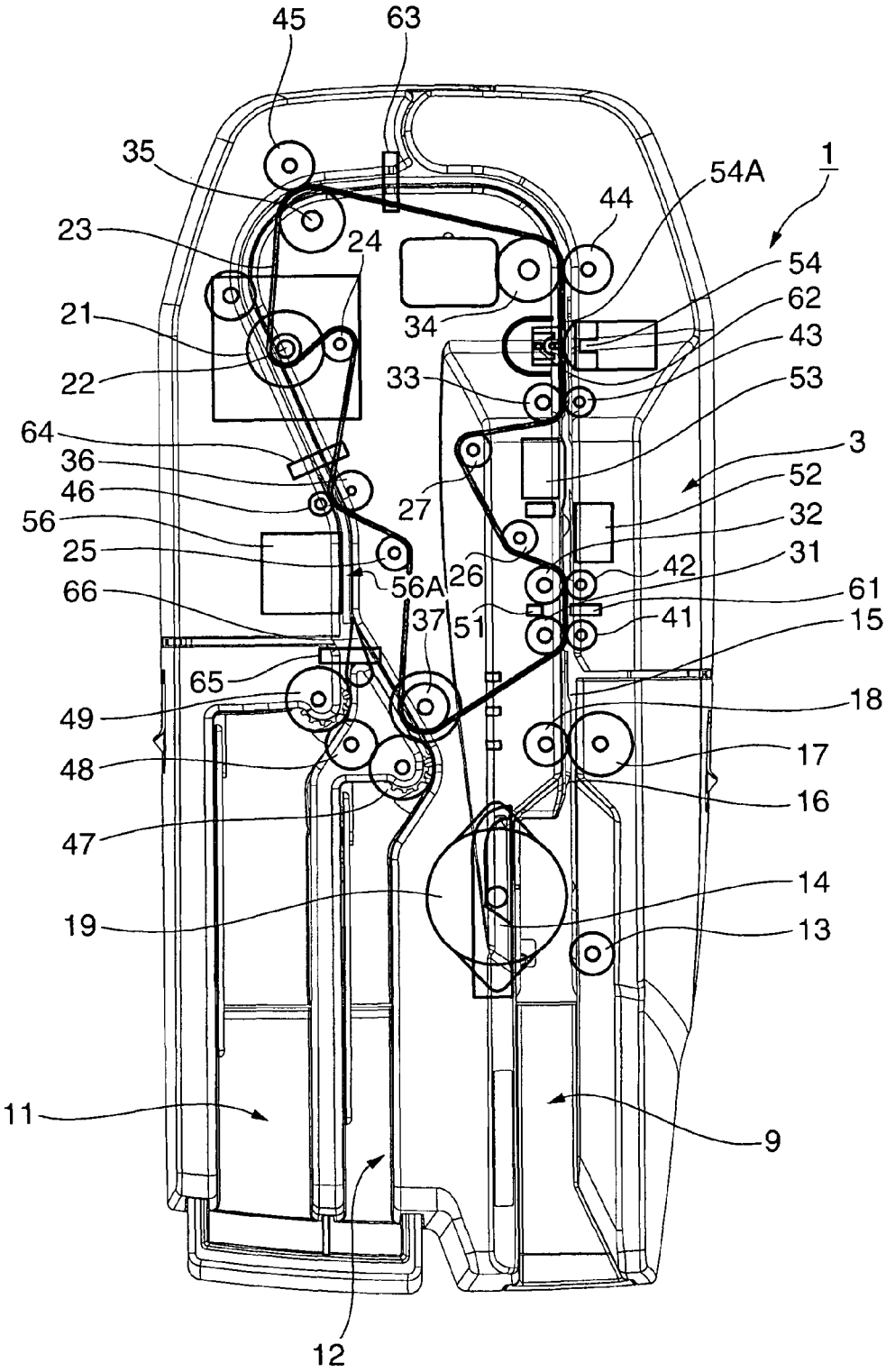
FIG. 3 describes the internal arrangement of the check processing device shown in FIG. 1.
Figure 4:
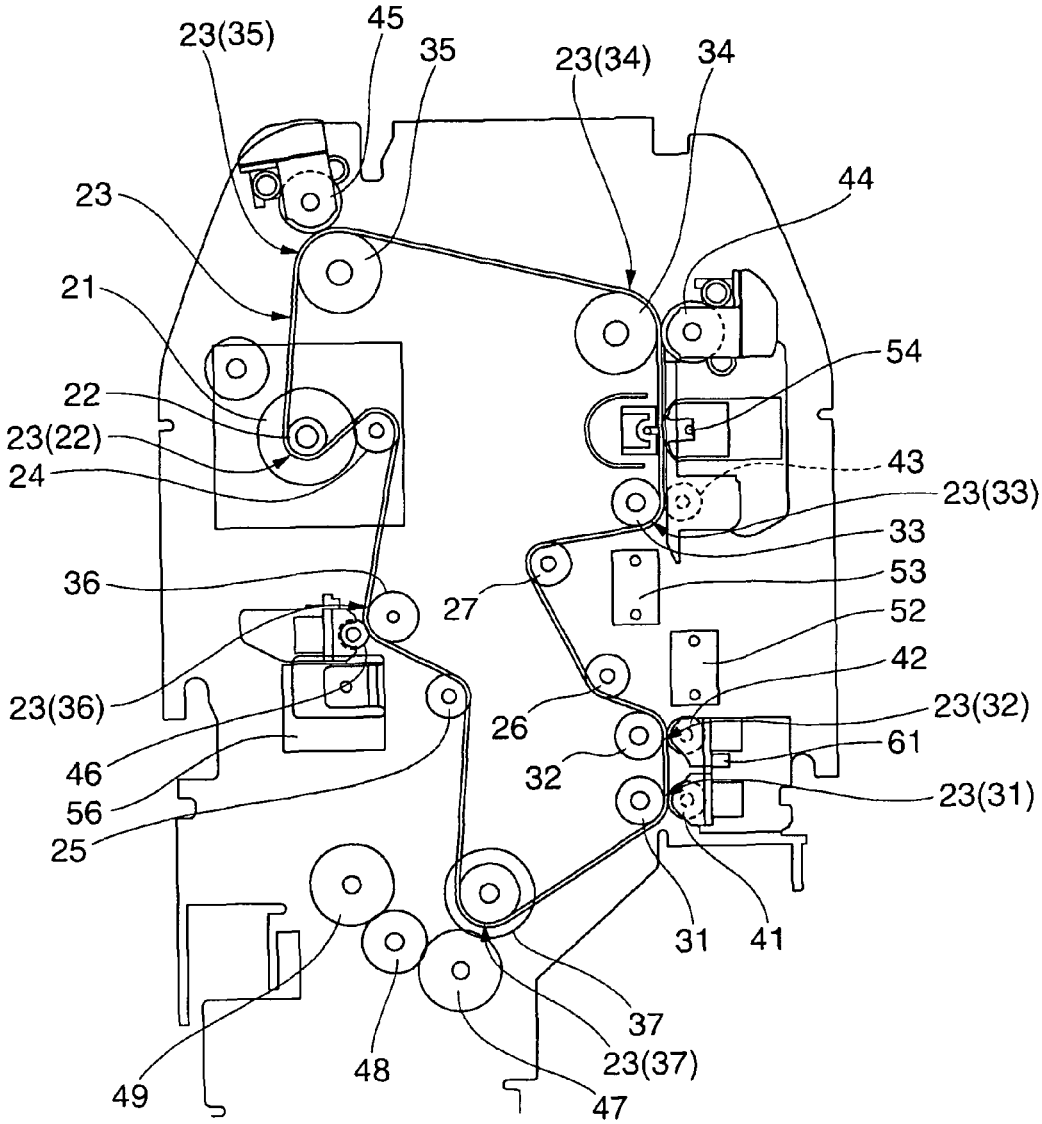
FIG. 4 describes the check transportation mechanism.

FIG. 3 describes the check transportation mechanism rendered in the check processing device 1, and FIG. 4 describes the part of this mechanism that conveys checks through the transportation path 5.

Referring first to FIG. 3, an infeed roller 13 and a pressure member 14 are disposed to the check loading unit 9. The infeed roller 13 feeds checks 4 which are loaded in a stack in the check loading unit 9 into the transportation path 5. The pressure member 14 presses the checks 4 against the infeed roller 13.

Disposed to the infeed path 15 for feeding the checks 4 delivered by the infeed roller 13 into the transportation path 5 are a separation pad 16 and a pair of separation rollers including a separation roller 17 and a retard roller 18. The separation pad 16, separation roller 17, and retard roller 18 render a separation mechanism for separating and feeding the checks 4 one at a time from the stack into the transportation path 5. The separation pad 16 is made from cork, urethane, or other material with a high coefficient of friction. The infeed roller 13, the separation roller 17, and the pressure member 14 are driven by a common feed motor 19.

Referring to FIG. 3 and FIG. 4, the transportation mechanism for conveying the checks 4 along the transportation path 5 includes a transportation motor 21, a drive pulley 22 mounted on the rotating shaft of the transportation motor 21, a set of transportation rollers 31 to 36 disposed along the transportation path 5, a transfer pulley 37, a set of pressure rollers 41 to 46 that are pressed against and rotate with the transportation rollers 31 to 36, and a pressure roller 47 that is driven by the transfer pulley 37.

Rotation of the pressure roller 47 is transferred through a transfer gear 48 to a discharge roller 49. An endless belt 23 transfers rotation of the transportation motor 21 shaft to the transportation rollers 31 to 36. The endless belt 23 travels along an endless loop from the drive pulley 22 passed a guide roller 24, a transportation roller 36, a guide pulley 25, the transfer pulley 37, transportation rollers 31 and 32, guide pulleys 26 and 27, transportation rollers 33, 34, and 35, and back to the drive pulley 22.

The transportation rollers 31 to 34 are located at the upstream end, the middle, and at the junction to the curved transportation path portion 7. Transportation roller 35 is located on the downstream side of the curved transportation path portion 7. Transportation roller 36 is in the middle of the downstream-side transportation path portion 8, and transfer pulley 37 is located at the discharge opening to the second check discharge unit 12. A discharge roller 49 is disposed at the discharge opening to the first check discharge unit 11.

A magnet 51 for magnetizing the magnetic ink characters is disposed between the transportation rollers 31 and 32 in the upstream-side transportation path portion 6. A front contact image sensor 52 is disposed as the front image scanner, and a back contact image sensor 53 is disposed as a back image scanner, between the transportation rollers 32 and 33. A magnetic head 54 for magnetic ink character reading is disposed between transportation rollers 33 and 34.

A print mechanism 56 is disposed on the downstream side of the transportation roller 36 in the downstream-side transportation path portion 8. The print mechanism 56 can move between a printing position applying pressure to the check 4 and a standby position retracted from this printing position by means of a drive motor (not shown in the figure). The print mechanism 56 can also be rendered as a stamp mechanism that is pushed by a plunger to print (stamp) the check 4.

Various sensors for check transportation control are also disposed to the transportation path 5.

A paper length detector 61 for detecting the length of the conveyed check 4 is located near the magnet 51.

A multifeed detector 62 for detecting if two or more checks 4 are being fed together is located between transportation roller 34 and transportation roller 33.

A jam detector 63 is located at a position on the upstream side of the transportation roller 35. A check is known to be jammed in the transportation path 5 if the jam detector 63 detects a check 4 continuously for a prescribed time or longer.

A print detector 64 for detecting the presence of a check 4 printed by the print mechanism 56 is located on the upstream side before the transportation roller 66.

A discharge detector 65 for detecting the discharged check is disposed to the diversion paths 10*a* and 10*b* where the transportation path 5 branches to the first and second check discharge units 11 and 12.

A flapper 66 that is driven by a drive motor not shown to switch the discharge path is disposed on the upstream side of the diversion paths 10*a* and 10*b*. The flapper 66 selectively switches the downstream end of the transportation path 5 to the first check discharge unit 11 or the second check discharge unit 12, and guides the check 4 to the selected discharge unit.

The distance from the reading position 54A of the magnetic head 54 in the transportation path 5 to the printing position 56A of the print mechanism 56 is greater than the length of the long side (transportation direction) of the check 4 to be scanned in this embodiment of the invention. As a result, when the leading end of the check 4 reaches the printing position 56A, the trailing end has already passed the reading position 54A of the magnetic head 54. The check 4 is therefore sequentially conveyed by the transportation roller 34 and the pressure roller 44, and by the transportation roller 35 and the pressure roller 45, as the magnetic head 54 reads the magnetic ink characters.

The check 4 is also conveyed sequentially by the transportation roller 33 and pressure roller 43, by the transportation roller 34 and the pressure roller 44, and by the transportation roller 35 and the pressure roller 45 as the contact image sensors 52 and 53 image the front and back of the check 4.

Positioning of the Transportation Rollers

The positions where the endless belt 23 engages each of the transportation rollers in the check transportation mechanism according to this embodiment of the invention are set as follow.

As will be understood from FIG. 4, the roller engaging part that is next on the upstream side in the belt drive direction from the belt drive roller engaging part 23(22) where the endless belt 23 wraps around the drive pulley 22 is a first roller engaging part 23(35) where the endless belt 23 wraps around the transportation roller 35. The roller engaging part that is next on the upstream side from this first roller engaging part 23(35) is a second roller engaging part 23(34) where the endless belt 23 winds round the transportation roller 34. Continuing upstream in the belt drive direction are roller engaging parts 23(33), 23(32), 23(31), 23(37), and 23(36) at transportation rollers 33, 32, 31, transfer pulley 37, and transportation roller 36.

Transportation Rollers 31 and 32

Figure 5A:
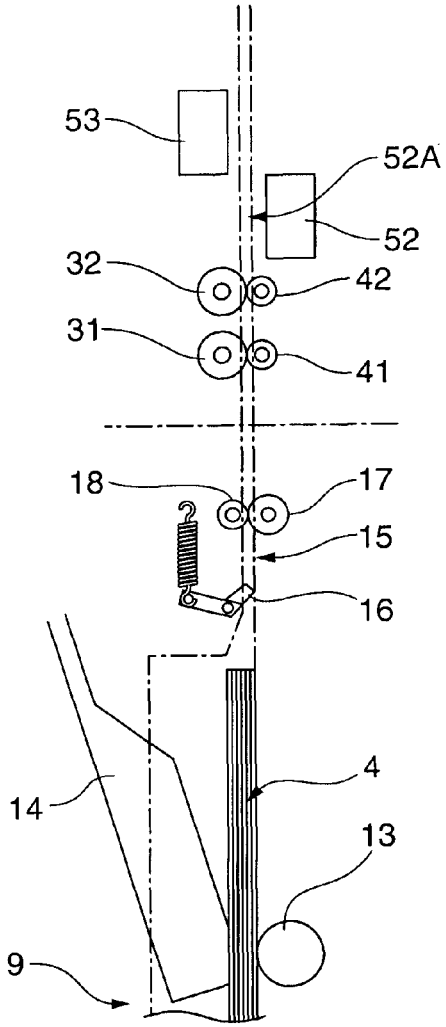
FIG. 5A describes the part of the check transportation mechanism from the separation mechanism to the scanning position.

FIG. 5A shows the part of the check 4 transportation mechanism from the check loading unit 9 to the scanning position 52A of the front contact image scanner 52. As shown in this figure two transportation rollers 31 and 32 are located between the scanning position 52A of the front contact image scanner 52 and the separation pad 16, separation roller 17, and retard roller 18. A check 4 delivered through the separation mechanism is fed first into the nipping part of the transportation roller 31 and the pressure roller 41, from there to the nipping part of the transportation roller 32 and the pressure roller 42, and then passed the scanning position 52A of the front contact image scanner 52.

Figure 5B:
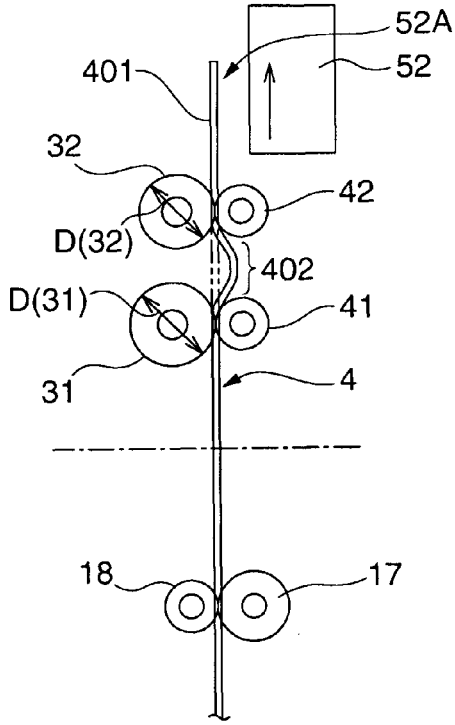
FIG. 5B describes check transportation from the separation mechanism to the scanning position.

As shown enlarged in FIG. 5B, the outside diameter D(31) of transportation roller 31 is slightly greater than the outside diameter D(32) of the downstream transportation roller 32. A diameter that is approximately 2% to 3% larger is particularly effective. As described above, the endless belt 23 engages transportation rollers 31 and 32 so that the rollers are driven rotationally by a common transportation motor 21. Both rollers therefore turn at the same angular velocity. The larger diameter upstream transportation roller 31 therefore has a faster peripheral velocity and feeds checks faster than the smaller downstream transportation roller 32. The same effect can be achieved by driving the transportation roller 31 at a faster angular velocity than the downstream transportation roller 32.

As a result, even if some slipping occurs between this first transportation roller 31 and the check 4 during check transportation due to resistance from the separation mechanism, the part 402 of the check 4 between the first and second transportation rollers 31 and 32 becomes slightly slack as shown in the figure because the first transportation roller 31 feeds the check slightly faster than the second transportation roller 32. This slack prevents passing feed resistance and variations in the transportation load through the first transportation roller 31 to the second transportation roller 32. This also inhibits variation in the feed load on the second transportation roller 32 even if the coefficient of friction between the check 4 and the transportation rollers varies.

More specifically, variation in slippage between the transportation rollers and the check 4 caused by feed resistance imposed by the separation mechanism and change in the coefficient of friction between the check 4 and the transportation rollers works on the first transportation roller 31 but does not work on the second transportation roller 32. Variation in the feed load on the second transportation roller 32 and variation in the relay capacity of the first roller are suppressed, and the part 401 of the check 4 that is fed from the transportation roller 32 passes the scanning position 52A at a constant speed.

Control System

Figure 6:
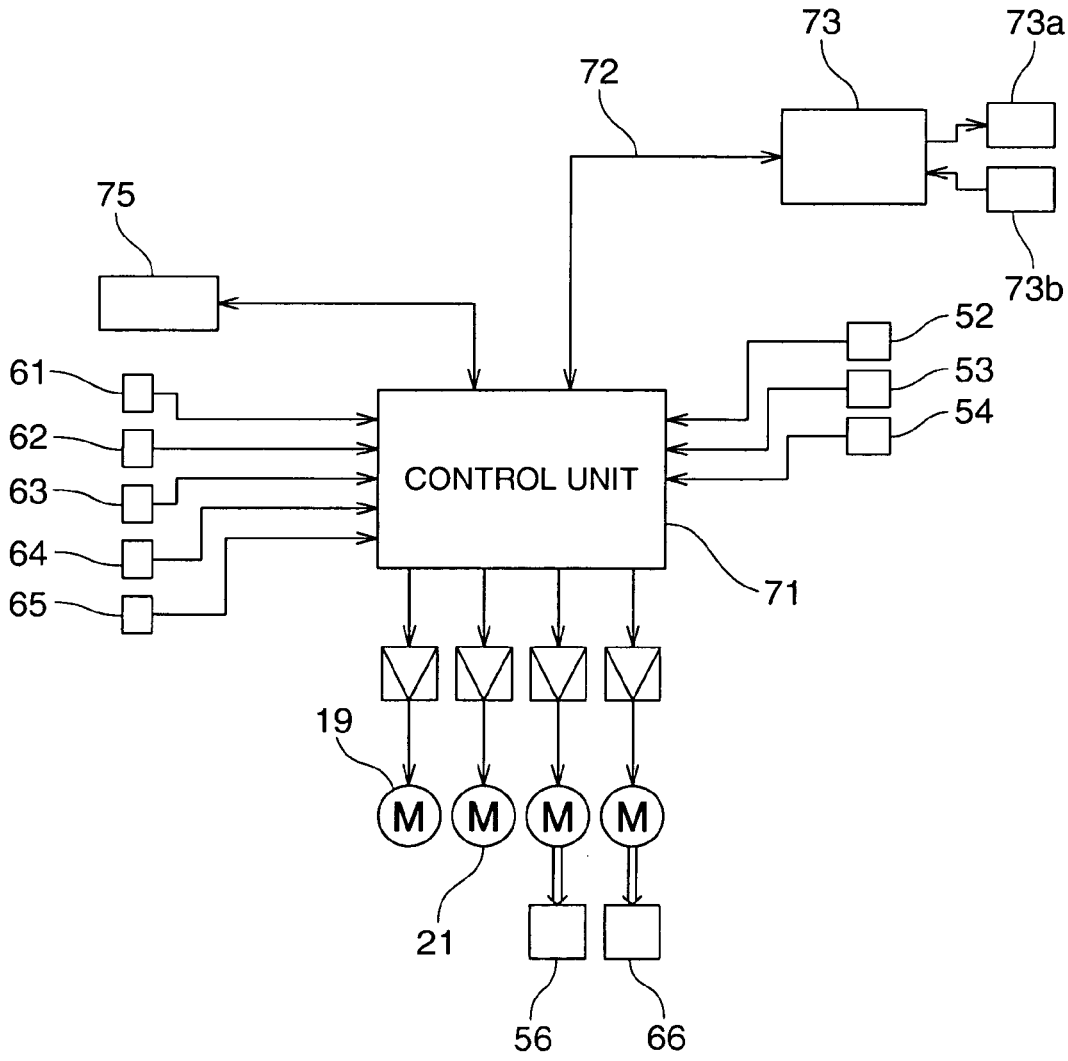
FIG. 6 is a block diagram of the control system of the check processing device shown in FIG. 1.

FIG. 6 is a block diagram showing the control system of the check processing device 1. The control system of this check processing device 1 includes a control unit 71 that is built around a CPU and has RAM and ROM. The control unit 71 is connected to a host computer system 73 through a communication cable 72. The computer system 73 has a display unit 73*a* and input/output devices such as a keyboard, mouse, or other operating unit 73*b*. Check scanning operation start commands and other commands are input from the computer system 73 to the control unit 71.

When a scanning operation start command is received, the control unit 71 drives the feed motor 19 and the transportation motor 21 to feed the checks 4 one at a time into the transportation path 5 and convey the supplied check 4 through the transportation path 5. The front image data, back image data, and magnetic ink character data captured from the check 4 by the front contact image sensor 52, the back contact image sensor 53, and the magnetic head 54 are input to the control unit 71. This data is then supplied to the computer system 73 for image processing and character recognition processing. The computer system 73 also determines if the check 4 was scanned normally, and the result is supplied to the control unit 71. Based on this result the control unit 71 controls driving the print mechanism 56 and the flapper 66.

The control unit 71 controls conveying the check 4 based on the detection signals from the paper length detector 61, the multifeed detector 62, the jam detector 63, the print detector 64, and the discharge detector 65 that are disposed along the check transportation path 5. An operating unit 75 including a power supply switch and other switches is also disposed to the case 2 and connected to the control unit 71.

Figure 7:
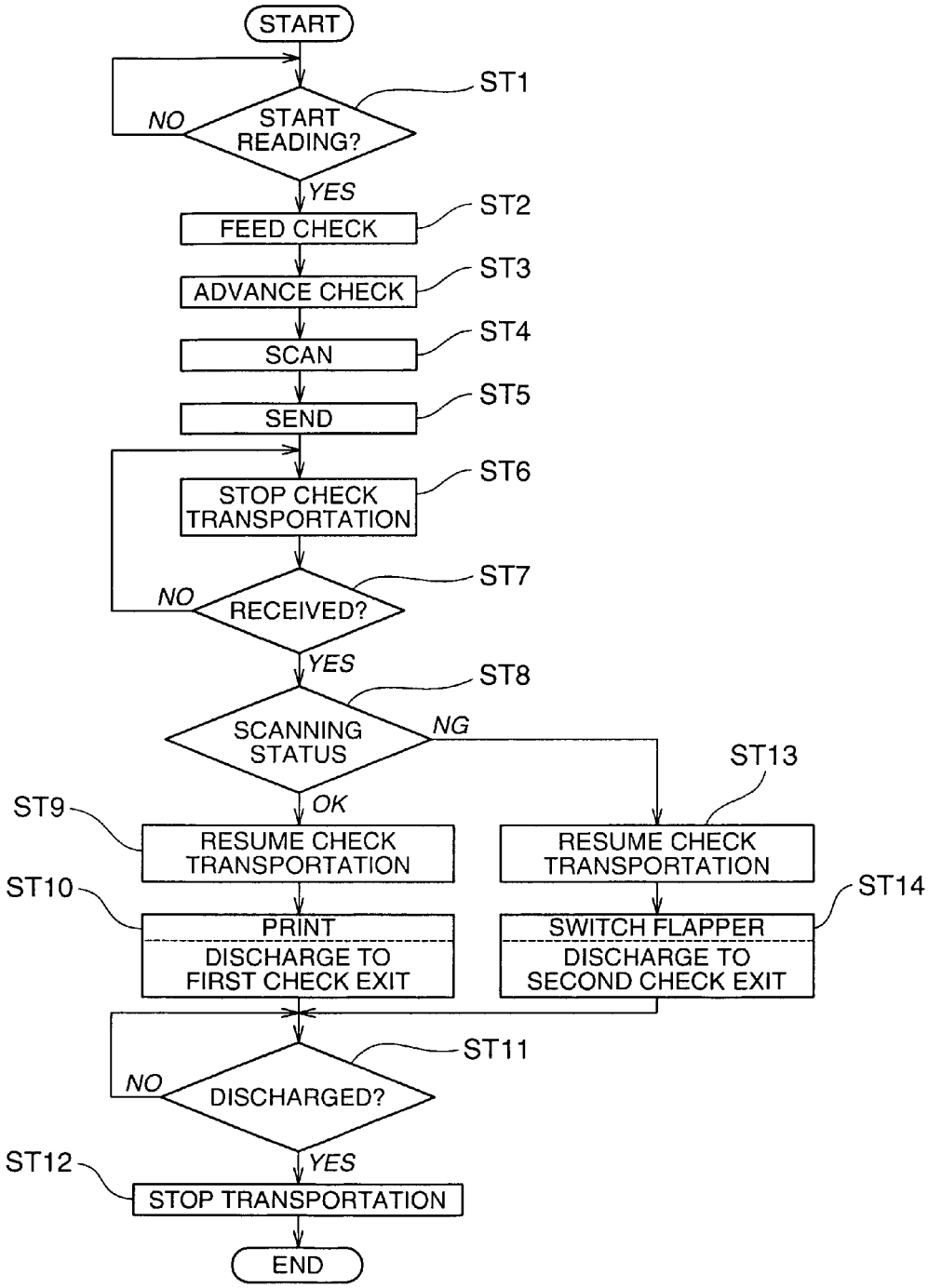
FIG. 7 is a flow chart describing the operation of the check processing device shown in FIG. 1.

FIG. 7 is a flow chart describing the operation of the control unit 71 of the check processing device 1. The scanning operation is described next with reference to this flow chart.

When the operator inputs a start scanning command from the operating unit 73*b* of the host computer system 73, the feed motor 19 causes the infeed roller 13 to turn and the pressure member 14 to move and press the checks 4 against the infeed roller 13. One or more checks 4 are thus advanced by the infeed roller 13. The separation mechanism (separation pad 16, separation roller 17, and retard roller 18) disposed to the infeed path 15 then separates and feeds the checks 4 delivered into the infeed path 15 one by one into the transportation path 5 (steps ST1 and ST2).

When the paper length detector 61 detects the leading end of the conveyed check 4, the transportation motor 21 is driven to rotationally drive the transportation rollers 31 to 36 and the transfer pulley 37. The supplied check 4 is passed sequentially to the transportation rollers 31 to 36 and transfer pulley 37 and conveyed through the transportation path 5 (step ST3). The front and back of the check 4 are imaged and the magnetic ink characters are read by the front contact image sensor 52, the back contact image sensor 53, and the magnetic head 54, respectively, as the check 4 is conveyed (step ST4).

The captured data is then sent through the communication cable 72 to the host computer system 73 (step ST5). The computer system 73 processes the scanned front image, back image, and magnetic ink character data, and determines if the check was read correctly. If the check 4 is fed with the top and bottom upside down, the magnetic ink characters cannot be recognized and a read error results. If the check 4 is fed with the front and back reversed, the magnetic ink character data cannot be acquired and a read error results. If the check 4 is creased, torn, or skewed when fed so that a portion of the magnetic ink characters cannot be read, a read error results. A read error also results if the check amount or other prescribed information cannot be recognized from the front and back image data because the check 4 is creased, torn, or skewed when fed.

Referring again to the check processing device 1 side, when the leading end of the conveyed check 4 reaches the printing position 56A of the print mechanism 56, the transportation mechanism pauses conveying the check 4 (step ST6). The position of the leading end of the conveyed check 4 is managed by counting the number of steps the transportation motor 21 is driven from when the paper length detector 61 detects the leading end of the check 4. When conveying the check 4 stops, the check processing device 1 waits for the scanning determination result from the computer system 73 (step ST7).

If the received scanning determination result indicates that the check 4 was scanned correctly, conveying the check 4 resumes and the print mechanism 56 is simultaneously moved to the printing position 56A (steps ST8 and ST9). The print mechanism 56 prints PROCESSED, for example, on the check 4 as the check 4 is advanced, and the check 4 is directed into the first check discharge unit 11 by the flapper 66 (step ST10). Driving the transportation mechanism stops after the discharge detector 65 detects the trailing end of the check 4 (steps ST11 and ST12). Feeding and processing the next check 4 then starts.

If the received scanning determination result indicates that the check 4 was not scanned correctly (step ST8), conveying the check 4 resumes (step ST13) and the flapper 66 changes position. The print mechanism 56 is held in the standby position and does not print on the check 4. The check 4 is thus diverted by the flapper 66 and discharged into the second check discharge unit 12 (step ST14). Driving the transportation mechanism stops after the discharge detector 65 detects the trailing end of the check 4 (steps ST11 and ST12), and the operation for scanning the next check 4 then starts.

If the multifeed detector 62 detects a check multifeed state, an interrupt process is executed to immediately stop check transportation, signal a check transportation error to the operator by driving a warning indicator on the operating unit 75, and then wait until the checks are removed from the check transportation path 5 and the checks are reset to the starting position. A similar interrupt process is executed if the jam detector 63 detects that a check is jammed in the check transportation path 5.

Effect

As described above, the check processing device 1 according to this embodiment of the invention disposes two transportation rollers 31 and 32 between the scanning position 52A of the front contact image scanner 52 and the separation roller 17 and retard roller 18 that create resistance to check transportation and variation in the check transportation load, and drives the upstream side transportation roller 31 faster than the other transportation roller 32 to convey the checks 4 with slack produced between the transportation rollers 31 and 32. Because there is slack in the part 402 of the check 4 that is between transportation rollers 31 and 32, transportation resistance imposed by the separation mechanism does not act on the downstream transportation roller 32.

The transportation load that acts on the transportation roller 31 that feeds the check 4 to the scanning position 52A can thus be reduced, and variation in the transportation load can be suppressed. As a result, there is very little slipping between the second transportation roller and the sheet media even when the transportation speed is fast. The checks 4 can therefore be conveyed passed the scanning position 52A at a constant speed without increasing the relay capacity of the transportation roller 32, and a drop in scanning precision can be prevented. A drop in the reading accuracy of the magnetic head 54 that is near the contact image scanner 52 can also be prevented. The reading (scanning) position in this case is at the magnetic head 54.

The invention is described above using a check processing device by way of example, but the invention is not limited thereto and can be used in other media processing devices such as printers and scanners that are used to process checks and other types of sheet media.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A media processing device, comprising:

a media transportation path for conveying sheet media in a downstream direction, the transportation path extending substantially in a vertical direction, wherein said transportation path is configured to orient said sheet media such that a front of the sheet media is substantially parallel to the vertical direction at a beginning of the media transportation path;

an information reader that reads information contained on the front of sheet media;

a separation mechanism that separates and feeds the sheet media;

a transportation mechanism that conveys the sheet media delivered from the separation mechanism toward the information reader, the transportation mechanism including a first transportation roller and a second transportation roller disposed downstream of the first transportation roller relative to a transportation direction of the sheet media; and a common driving source adapted to rotate both the first transportation roller and the second transportation roller;

wherein a speed of the first transportation roller is greater than a speed of the second transportation roller and wherein the information reader is positioned downstream of the first and second transportation rollers, and said first and second transportation rollers are positioned downstream of said separation mechanism.

2. The media processing device described in claim 1, wherein a peripheral velocity of the first transportation roller is approximately 2% to 3% greater than a peripheral velocity of the second transportation roller.

3. The media processing device described in claim 1, wherein an angular velocity of the first transportation roller and an angular velocity of the second transportation roller are substantially the same, and the outside diameter of the first transportation roller is greater than the outside diameter of the second transportation roller.

4. The media processing device described in claim 1, wherein the outside diameter of the first transportation roller and the outside diameter of the second transportation roller are substantially the same, and an angular velocity of the first transportation roller is greater than an angular velocity of the second transportation roller.

5. The media processing device described in claim 1, wherein the separation mechanism includes a separation roller and a retard roller that is pressed toward the separation roller.

6. The media processing device described in claim 1, wherein the separation mechanism includes a separation pad.

7. The media processing device described in claim 1, wherein the information reader comprises one or both of a magnetic head and a scanner.

* * * * *